US005355930A

United States Patent [19]

Donahue et al.

[11] Patent Number: 5,355,930

[45] Date of Patent: Oct. 18, 1994

[54] METHOD OF EXPENDABLE PATTERN CASTING OF HYPEREUTECTIC ALUMINUM-SILICON ALLOYS USING SAND WITH SPECIFIC THERMAL PROPERTIES

[75] Inventors: Raymond J. Donahue, Fond du Lac; Terrance M. Cleary, Allenton; William G. Hesterberg, Rosendale, all of Wis.; Terry C. Holmgren, Ishpeming, Mich.

[73] Assignee: Brunswick Corporation, Skokie, Ill.

[21] Appl. No.: 119,027

[22] Filed: Sep. 9, 1993

Related U.S. Application Data

[63] Continuation-in-part of Ser. No. 940,485, Sep. 4, 1992, abandoned.

[51] Int. Cl.[5] ..... B22C 7/02

[52] U.S. Cl. ..... 164/34; 164/529

[58] Field of Search ..... 164/34, 520, 529, 122

[56] References Cited

U.S. PATENT DOCUMENTS

| | | | |
|---|---|---|---|
| 3,333,579 | 8/1967 | Shockley . | |
| 3,536,123 | 10/1970 | Izumi | 164/114 |
| 4,113,473 | 9/1978 | Gauvry | 75/148 |
| 4,139,045 | 2/1979 | Vitt | 164/34 |
| 4,603,665 | 8/1986 | Hesterberg et al. | 123/195 |
| 4,693,292 | 9/1987 | Campbell | 164/34 |
| 4,711,287 | 12/1987 | Kuwabara et al. | 164/34 |
| 4,804,032 | 2/1989 | Wilkins | 164/34 |
| 4,821,694 | 4/1989 | Hesterberg et al. | 123/195 |
| 4,875,517 | 10/1989 | Donahue et al. | 164/34 |
| 4,902,475 | 2/1990 | Apelain et al. | 420/548 |
| 4,966,220 | 10/1990 | Hesterberg et al. | 164/34 |
| 4,969,428 | 11/1990 | Donahue et al. | 123/195 |
| 5,129,378 | 7/1992 | Donahue et al. | 123/193.4 |

OTHER PUBLICATIONS

Metals Handbook, 9th Ed., vol. 15, p. 233, Sep. 1988.

*Primary Examiner*—P. Austin Bradley
*Assistant Examiner*—Erik R. Puknys
*Attorney, Agent, or Firm*—Andrus, Sceales, Starke & Sawall

[57] ABSTRACT

A method of producing a casting utilizing an expendable polymeric foam pattern along with unbonded sand having specific thermal properties. The pattern, formed of a material such as polystyrene, has a configuration corresponding to that of the article to be cast. The pattern is placed with an outer flask and unbonded sand surrounds the pattern as well as filling the cavities in the pattern. The sand has a heat diffusivity greater than 1500 $J/m^2/°K./s^{\frac{1}{2}}$. The molten hypereutectic aluminum silicon alloy is fed into the flask in contact with the pattern causing the pattern to vaporize with the vapor being entrapped within the interstices of the sand while the molten metal fills the space initially occupied by the foam pattern to produce a cast article. The thermal properties of the sand reduces the particle size of the precipitated primary silicon particles in the casting, thereby increasing the machinability of the casting.

7 Claims, No Drawings

METHOD OF EXPENDABLE PATTERN CASTING OF HYPEREUTECTIC ALUMINUM-SILICON ALLOYS USING SAND WITH SPECIFIC THERMAL PROPERTIES

This application is a continuation-in-part of application Ser. No. 07/940,485, filed Sep. 4, 1992, now abandoned.

BACKGROUND OF THE INVENTION

Expendable Pattern casting, also known as lost foam casting, is a known casting technique in which a pattern formed of an polymeric foam material, such as polystyrene or polymethylmethacrylate, is supported in a flask and surrounded by an unbonded particulate material, such as silica sand. When the molten metal contacts the pattern, the foam material decomposes with the products of decomposition passing into the interstices of the sand while the molten metal replaces the void formed by the expended foam material to produce a cast part which is identical in configuration to the pattern.

In the conventional expendable pattern casting process, the sand which surrounds the pattern and fills the cavities in the pattern is unbonded and free flowing and this differs from traditional sand casting processes, wherein the sand is utilized with various types of binders. However, after compaction, the unbonded sand density is generally higher than the density of molds made with bonded sand, and therefore the rigidity or stiffness of compacted unbonded sand is not deficient relative to bonded sand molds.

Traditionally, silica sand has been used exclusively as the molding material in expendable pattern casting because it is readily available and inexpensive.

Aluminum silicon alloys have been cast utilizing expendable pattern casting techniques as disclosed in U.S. Pat. No. 4,966,220. Aluminum silicon alloys containing less than about 11.6% by weight of silicon are referred to as hypoeutectic alloys and the unmodified alloys have a microstructure consisting of primary aluminum dendrites, with a eutectic composed of acicular silicon in an aluminum matrix. Hypoeutectic aluminum silicon alloys have seen extensive use in the past but lack wear resistance.

Hypereutectic aluminum silicon alloy, those containing more than about 11.6% silicon, contain primary silicon crystals which are precipitated as the alloy is cooled between the liquidus temperature and the eutectic temperature. Due to the high hardness and higher modulus of the precipitated primary silicon crystals, these alloys have good wear resistance but are difficult to machine, if the primary silicon particle size is large, a condition which limits their use as casting alloys. These alloys also have a high-cycle fatigue strength, 50% higher than typical hypoeutectic aluminum-silicon alloys, because hypereutectic aluminum-silicon alloys do not contain the primary aluminum phase associated with hypoeutectic aluminum silicon alloys. These higher fatigue strengths, however, have not been utilized in practice because hypereutectic aluminum-silicon alloys are not used commercially in sand casting processes, such as expendable pattern casting.

Normally, a solid phase in a "liquid plus solid" field has either a lower or higher density than the liquid phase, but almost never the same density. If the solid phase is less dense than the liquid phase, floatation of the solid phase will result. On the other hand, if the solid phase is more dense, a settling of the solid phase will occur. In either case, an increased or widened solidification range, which is a temperature range over which an alloy will solidify, will increase the time period for solidification and accentuate the phase separation. With a hypereutectic aluminum-silicon alloy, the silicon particles have a lesser density than the liquid phase so that the floatation condition prevails. Thus, as the solidification range is widened, the tendency for floatation of large primary silicon particles increases, thus resulting in a less uniform distribution of silicon particles in the cast alloy. Conversely, if the rate of cooling through the solidification range is increased, the tendency for floatation of the primary silicon particles is decreased resulting in a more uniform distribution of smaller silicon particles in the alloy. However, at sand casting cooling rates, improvements in wear resistance or machinability by using different sand types, have not been recognized.

It is recognized in the casting art that using a molding material that extracts heat more rapidly from the molten metal and allows it to solidify at a faster rate, yields a casting with superior mechanical properties. A cooling rate increase of three orders of magnitude (i.e. a 1000 times increase) decreases the dendritic arm spacing of the primary aluminum phase of hypoeutectic aluminum-silicon alloys by one order of magnitude (i.e. a factor of 10). This microstructure change results in an increase in mechanical properties. Thus, castings produced using metal molds, which extract heat rapidly, generally exhibit superior mechanical properties as opposed to castings produced by sand casting or expendable pattern casting processes that utilize sand as a molding material. However, when using sand as a molding material, as in sand casting or expendable pattern casting, doubling the cooling rate (which is theoretically the most that can be expected from the higher heat diffusivity obtainable with any sand media), decreases the dendritic arm spacing of hypoeutectic aluminum-silicon alloys by approximately 10% and this reduction results in only a 5% increase in the ultimate tensile strength. Thus sand casting properties of hypoeutectic aluminum-silicon alloys are never listed in the reference books by sand type.

SUMMARY OF THE INVENTION

The invention is directed to a method of expendable pattern casting hypereutectic aluminum-silicon alloys containing from about 16% to 30% by weight of silicon, and utilizing a sand molding material having specific physical properties to produce castings having a smaller primary silicon particle size.

In the method of the invention, a polymeric foam pattern is produced having a configuration corresponding to the article to be cast. The foam pattern is supported in a flask and an unbonded sand is fed into the flask, surrounding the pattern and filling the cavities in the pattern.

The sand has a heat diffusivity greater than 1500 $J/m^2/°K./s^{\frac{1}{2}}$. Chromite sand, silicon carbide sand, olivine sand, and carbon sand have properties and are examples of sands which can be utilized. In addition, the sand preferably has an AFS base permeability number of 450 to 500. Base permeability, expressed as AFS permeability number, is the rate in milliliters per minute at which air will pass through the sand under a standard condition of pressure of 1 $gram/cm^2$ through a specimen 1 $cm^2$ in cross sectional area and 1 cm high.

When the foam pattern is contacted by the molten metal, the pattern will decompose and the products of decomposition will be entrapped within the interstices of the unbonded sand while the metal will fill the space initially occupied by the foam pattern, thereby producing a cast article which corresponds in configuration to the foam pattern.

It has been discovered that the thermal and physical properties of the sand, coupled with the endothermic heat losses in melting and decomposing the foam, allow heat to be extracted at a faster rate from the molten hypereutectic aluminum-silicon alloy, thus enhancing under-cooling below the liquidus of the molten alloy and increased nucleation of the primary silicon resulting in a smaller primary silicon particle size in the cast article, thereby improving the machinability of the casting.

Other objects and advantages will appear in the course of the following description.

Description of the Preferred Embodiment

The invention relates to a method of expendable pattern casting of hypereutectic aluminum-silicon alloys utilizing unbonded sand having specific thermal and physical properties as a molding material.

In carrying out the invention, a polymeric foam pattern is produced from a material such as polystyrene or polymethylmethacrylate to provide a pattern having a configuration corresponding to that of the article to be cast. The foam pattern itself is produced by conventional procedures.

As in conventional expendable foam casting, the pattern can be coated with a porous ceramic material which acts to prevent a metal/sand reaction and facilitates cleaning of the cast metal part. The ceramic coating is normally applied by immersing the pattern in a bath of ceramic wash, draining the excess wash from the pattern and drying the wash to provide the porous ceramic coating.

In general, the hypereutectic aluminum silicon alloys contain by weight 12% to 30% silicon, 0.4% to 5.0% magnesium, up to 0.3% manganese, up to 1.4% iron, up to 5.0% copper, and the balance aluminum.

Specific examples of hypereutectic aluminum silicon alloys to be used are as follows in weight percent:

EXAMPLE 1

| | |
|---|---|
| Silicon | 16.90% |
| Iron | 0.92% |
| Copper | 0.14% |
| Manganese | 0.12% |
| Magnesium | 0.41% |
| Aluminum | 81.51% |

EXAMPLE 2

| | |
|---|---|
| Silicon | 20.10% |
| Iron | 0.20% |
| Copper | 0.33% |
| Manganese | 0.18% |
| Magnesium | 0.71% |
| Aluminum | 78.40% |

Traditionally, silica sand has been used as the molding material in expendable pattern casting due to the fact that silica sand is readily available and is inexpensive. Through the development of the invention, it has been discovered that the use of silica sand presents certain drawbacks when utilized in expendable pattern casting procedures of hypereutectic aluminum-silicon alloys that were heretofore unrecognized, and it has been further discovered that the unbonded sand molding material should have certain physical properties, not obtainable with silicon sand, in order to obtain castings having a smaller primary silicon particle size.

It has been discovered that when dealing with hypereutectic aluminum-silicon alloys, primary silicon particle size is primarily affected by the initial cooling rate just below the liquidus (for which sand type has an influence) rather than by a faster average cooling rate through the entire liquid plus solid solidification range and heavily influenced by a high eutectic volume fraction.

The physical properties of sand, particularly the thermal properties, greatly effect the size and distribution of the primary silicon particles. The sand should have a heat diffusivity greater than 1500 $J/m^2/°K./s^{\frac{1}{2}}$. Chromite sand ($FeCr_2O_4$), silicon carbide sand, carbon sand, and olivine sand (a solid solution of forsterite, $Mg_2SiO_4$, and fayalite, $Fe_2SiO_4$) are examples of sands that can be used in the process of the invention. To minimize surface defects in the casting, the AFS base permeability number of the sand should be in the range of 450 to 500.

A comparison of the physical properties of chromite sand, silicon carbide sand and silica sand are shown in the following table.

TABLE I

| | Silica Sand | Chromite Sand | Silicon Carbide Sand |
|---|---|---|---|
| Thermal conductivity (watts/m/°K.) | 0.90–0.61 | 1.09 | 3.25 |
| Density ($Kg/m^3$) | 1500 | 2400 | 2000 |
| Specific heat (J/Kg/°K.) | 1130–1172 | 963 | 840 |
| Thermal diffusivity ($m^2s/ \times 10^{-6}$) | 0.360–0.512 | 0.472 | 2.0 |
| Heat diffusivity ($J/m^2/°K./s^{\frac{1}{2}}$) | 1017–1258 | 1587 | 2340 |

The thermal conductivity of a material is the quantity of heat which flows per unit time through a unit area of a mass of the material of unit thickness when there is a difference of 1° in the temperatures across opposite faces of the mass. The time rate of change of the temperature, at any location is proportional to the instantaneous slope of temperature gradient. The proportionality constant is called the thermal diffusivity and is defined as the thermal conductivity divided by the volumetric heat capacity where the volumetric heat capacity is the heat per unit volume necessary to raise the temperature of the mass 1°.

The heat diffusivity, on the other hand, is a measure of the rate at which the mold can absorb heat and is the square root of the product of the thermal conductivity, the density and the specific heat. As such, heat diffusivity is directly related to solidification rate of the molten metal.

As noted above, the heat diffusivity of the sand is directly related to the solidification rate of the molten metal. From the heat diffusivity data shown in Table I above, it is seen that the use of chromite sand should increase the solidification rate of the molten metal i.e. the time required to pass between the liquidus and solidus temperatures, over that using silica sand by approximately 27% to 56%, while the use of silicon carbide sand should increase the solidification rate of the molten metal over that obtained by silica sand by approximately 86% to 130%. This is due to the greater heat diffusivity of the chromite sand and the silicon carbide sand.

An unexpected enhanced nucleating phenomena is obtained when utilizing hypereutectic aluminum silicon alloys in the process of the invention. With hypereutectic aluminum silicon alloys, primary silicon crystals are precipitated as the alloy is cooled from solution temperature. When hypereutectic aluminum silicon alloys are cast in the process of the invention using the sand of the above-noted thermal properties, heat is more readily extracted from the molten metal (before heat saturation occurs at the molten metal/sand interface) which contributes to enhanced undercooling below the liquidus temperature of the alloy which in turn promotes increased nucleation of the primary silicon resulting in a smaller silicon particle size in the cast article. The reduction in particle size of the silicon improves the machinability of the alloy making the cast alloy more valuable for articles such as engine blocks.

As noted above, the use of chromite sand produces at least a 27% increase in the solidification rate, as opposed to the use of silica sand. With hypereutectic aluminum-silicon alloys the primary silicon particle size appears to be very sensitive to a marginal increase of 27% in the solidification rate. The reason for this unrecognized sensitivity is because different fundamental mechanisms are operating. The silicon particle size of hypereutectic aluminum-silicon alloys is controlled by a nucleation mechanism and this in turn is controlled by the character of the undercooling immediately below the liquidus.

A consideration of the microstructure of hypereutectic aluminum-silicon alloys is helpful in illustrating how the heat of fusion is dissipated during solidification in the alloy. At a temperature slightly above the eutectic temperature, a hypereutectic aluminum-silicon alloy of Example 1 (microstructure: 10% primary silicon, 90% eutectic liquid) has given up heat to the sand molding material, approximately equivalent to a hypoeutectic aluminum-silicon alloy of 7% silicon content and having a microstructure containing 40% primary aluminum and 60% eutectic liquid, since the heat of fusion of silicon is 4.5 times that of aluminum. However, as the remaining eutectic liquid solidifies, the hypereutectic alloy gives up incrementally 50% more heat on a volume basis which inherently slows the solidification of the hypereutectic alloy. The insight into obtaining a smaller primary silicon particle size in the hypereutectic alloy is to focus on the temperature range immediately below the liquidus temperature where the nucleation phenomena can be affected by an incremental faster cooling rate and not to focus on the temperature where silicon rejection is being accommodated by the growth of existing primary silicon particles. Thus, the use of chromite sand in the expendable pattern casting process, which can affect a 27–56% increase in the solidification rate (which shows a parabolic dependence with time and is therefore more effective in "early" time rather than in "late" time) has a most significant effect on primary silicon particle size, and this has heretofore not been recognized.

By comparison, die casting with large metal molds that function as very large heat sinks, overwhelms the nucleation at temperatures immediately below the liquidus temperature, as well as at temperatures immediately below the eutectic temperature. As a result, the die cast microstructure for a hypereutectic aluminum-silicon alloy, even containing no phosphorous additions, consists of a refined primary silicon as well as a refined eutectic silicon.

The microstructure of an expendable pattern cast hypereutectic aluminum-silicon alloy, by contrast, does not contain refined eutectic silicon in the microstructure because the cooling rate is far too slow. In fact, primary silicon refinement in a hypereutectic aluminum-silicon alloy requires phosphorous additions in all casting processes except a die casting process. In Gruzleski and Closset, "*The Treatment of Liquid Aluminum-Silicon Alloys*" (American Foundrymen's Society, Inc., 1990) it is stated that "hypereutectic alloys such as 390 are very difficult, if not impossible, to sand cast. Even with phosphorous treatment, solidification rates are so slow that unacceptably large primary phase particles form and float to the upper surfaces of the casting." Therefore, it has been believed that the cooling rate has an effect on the primary silicon particle size in a phosphorous treated alloy, but that the cooling rate effect refers to the entire liquid-solid range, as in die casting, and not just to the upper portion of the liquid-solid range. It is believed that the reason for this erroneous insight is that hypereutectic aluminum-silicon alloys have not been considered viable sand casting alloys and, therefore, sand casting developments with hypereutectic aluminum-silicon alloys have not been investigated for commercial use, and further primary silicon particle size has never been studied, as a function of sand type, in any of the various sand casting processes, which includes the expendable pattern casting where the endothermic heat losses in melting and decomposing the foam are significant.

The reduction in particle size of the silicon crystals can be illustrated by a comparison of casting a hypereutectic aluminum silicon alloy in an expendable pattern process using silica sand as a molding material as compared to using chromite sand. In this comparison, the aluminum silicon alloy contained 18.0% silicon, 0.69% magnesium, 0.1% copper, and the balance aluminum. The molten aluminum silicon alloy was poured at a temperature of 704° C. (1300° F.) into a flask containing silica sand at 26.7° C. (80° F.) and into a second chromite sand flask at 26.7° C. (80° F.), both containing a polystyrene sprue with three polystyrene foam patterns of a 60 horsepower three-cylinder engine block connected to the sprue. Differences in the primary silicon particle size were measured in the cast engine blocks with the two sand types. The average primary silicon particle size obtained by measuring 849 silicon particles utilizing silica sand in the casting was 30 microns with a coefficient of variation of primary silicon particle size of 50%. The average primary silicon particle size obtained by measuring 442 silicon particles produced using the chromite sand was 21.4 microns and a coefficient of variation in that average of 37%. Thus, the use of silica sand gave an average primary silicon particle size which was 39% larger than that obtained through use of chromite sand and the coefficient of variation of the particle size using silica sand was substantially greater than that obtained with the chromite sand. In general, the average primary silicon particle size of the cast hypereutectic aluminum-silicon alloy produced by the invention is less than 30 microns and the coefficient of variation of particle size is less than 50%

This test evidences the unexpected reduction in silicon particle size in a hypereutectic aluminum silicon alloy that is achieved when using the specified sand in an expendable pattern casting process.

Various modes of carrying out the invention are contemplated as being within the scope of the following claims particularly pointing out and distinctly claiming the subject matter which is regarded as the invention.

We claim:

1. A method of casting a hypereutectic-aluminum silicon alloy, comprising the steps of forming a pattern from an expendable polymeric foam material having a configuration corresponding to the article to be cast, positioning the pattern in spaced relation to an outer flask, introducing an unbonded flowable sand into the flask and surrounding said pattern, said sand having a heat diffusivity greater than $1500 J/m^2/°K./s^{\frac{1}{2}}$, preparing a molten hypereutectic aluminum-silicon alloy comprising from 12% to 30% by weight of silicon, 0.4% to 5.0% by weight of magnesium, up to 0.3% by weight of manganese, up to 1.4% by weight of iron, up to 5.0% by weight of copper, and the balance aluminum, pouring said molten alloy by gravity into contact with the pattern to thereby decompose the pattern with the products of decomposition being entrapped within the interstices of the sand, solidifying the alloy to precipitate particles of primary silicon and produce a cast article, said precipitated particles of primary silicon having an average particle size less than 30 microns, and a coefficient of variation less than 50%, and removing the cast article from the flask.

2. The method of claim 1, wherein the sand in the flask has an AFS base permeability number of 450 to 500.

3. The method of claim 1, wherein the cast article comprises an engine block for an internal combustion engine.

4. The method of claim 1, wherein the sand is selected from the group consisting of chromite sand, silicon carbide sand, olivine sand, carbon sand, and mixtures thereof.

5. A method of casting an engine block for an internal combustion engine, comprising the steps of forming a pattern of an expendable polymeric foam material having a configuration of an engine block and having a plurality of cylindrical bores, supporting the pattern in a flask, introducing unbonded sand into the flask to surround said pattern and fill said bores, said sand having a heat diffusivity greater than $1500 J/m^2/°K/s^{\frac{1}{2}}$, contacting the pattern with a molten hypereutectic aluminum-silicon alloy to thereby decompose the foam pattern with the products of decomposition being entrapped within the interstices of the sand, solidifying the alloy to produce a cast engine block containing precipitated particles of primary silicon having an average particle size of less than 30 microns, and removing the engine block from the flask.

6. The method of claim 5, wherein said alloy comprises 12% to 30% by weight of silicon, 0.4% to 5.0% by weight of magnesium, up to 0.3% by weight of manganese, up to 1.4% by weight of iron, up to 5.0% copper, and the balance aluminum.

7. The method of claim 5, wherein the precipitated particles of silicon have an average particle size less than 30 microns and the coefficient of variation of the particles is less than 50%.

* * * * *